US012302963B1

(12) United States Patent
Waite

(10) Patent No.: US 12,302,963 B1
(45) Date of Patent: May 20, 2025

(54) CAGE-LIKE FACE MASK

(71) Applicant: Rhys Waite, Alhambra, CA (US)

(72) Inventor: Rhys Waite, Alhambra, CA (US)

( * ) Notice: Subject to any disclaimer, the term of this patent is extended or adjusted under 35 U.S.C. 154(b) by 548 days.

(21) Appl. No.: 17/565,535

(22) Filed: Dec. 30, 2021

Related U.S. Application Data

(60) Provisional application No. 63/133,168, filed on Dec. 31, 2020.

(51) Int. Cl.
*A41D 13/11* (2006.01)

(52) U.S. Cl.
CPC ..... *A41D 13/1107* (2013.01); *A41D 13/1161* (2013.01)

(58) Field of Classification Search
CPC ..... A41D 13/11; A41D 13/1107; A41D 13/1161; A63B 71/085; A63B 71/10; A61F 5/0006; A42B 3/18; A42B 3/20
See application file for complete search history.

(56) References Cited

U.S. PATENT DOCUMENTS 2,281,181 A * 4/1942 Clarke ..... A41D 13/1161 128/206.13
4,291,417 A * 9/1981 Pagano ..... A42B 1/201 2/202
4,796,621 A 1/1989 Barle et al.
6,598,234 B1 7/2003 Brown et al.
6,802,079 B2 * 10/2004 Bush ..... A63B 71/085 128/857
2003/0070201 A1 4/2003 McClelland
2006/0053521 A1 3/2006 Rickon
2008/0297719 A1 12/2008 Brillouet
2009/0083891 A1 4/2009 Cote
2021/0345698 A1 * 11/2021 Chatzidakis ..... A41D 13/1161
2022/0151316 A1 * 5/2022 Grove ..... A62B 18/084

FOREIGN PATENT DOCUMENTS

DE 202020104668 U1 * 11/2020
DE 202020105656 U1 * 11/2020
KR 102192708 B1 * 12/2020

* cited by examiner

*Primary Examiner* — Keri J Nelson
(74) *Attorney, Agent, or Firm* — John Rizvi; John Rizvi, P.A.—The Patent Professor®

(57) ABSTRACT

A cage-like face mask for supporting a fabric or cloth covering to prevent the spread and contraction of diseases is provided. The face mask includes a main curved support and a pair of ear pieces extending from opposed ends of the main curved support. A main mobile curved support is pivotally connected to the main curved support and is releasably attached to the pair of ear pieces such that the face mask may be changed from a fully expanded condition for use to a fully collapsed condition for transport. One or more intermediary curved supports are provided and are pivotally connected to the main curved support to provided additional support to the fabric or cloth covering.

17 Claims, 7 Drawing Sheets

CAGE-LIKE FACE MASK

CROSS-REFERENCE TO RELATED APPLICATIONS

This application claims the benefit of U.S. Provisional Patent Application No. 63/133,168, filed on Dec. 31, 2020, which is incorporated by reference herein in its entirety.

FIELD OF THE INVENTION

The present invention relates generally to face masks, and more particularly, to a cage-like face mask for supporting a cloth or fabric covering to prevent the spread or contraction of diseases and protecting users from harmful airborne particles.

BACKGROUND OF THE INVENTION

Air borne disease have become more prevalent in recent years. These disease are typically transmitted person to person through exhalation of the breath from one who has contracted the disease. Prevention of the spread of the disease between persons is necessary to prevent large scale outbreaks of the diseases.

One method of preventing the disease is to personally distance oneself from others who, unbeknownst to those around them, may be carrying the diseases. However, maintaining a sufficient distance from a person who may be contagious is not always practical.

Additionally, many people are often exposed to dust, gasses and other airborne contaminates. These airborne particles may toxic and may be harmful if inhaled.

Facemasks worn over the mouth and nose of the user can prevent the user from spreading the diseases as it prevents the user from breathing on another person. Additionally, it can somewhat protect the user by filtering out the breath of another who may be contagious.

Unfortunately, most such face masks are formed of a completely soft fabric which is held tightly against the face of the user by the use of strings or loops placed over the users ears. This causes the fabric to be held tight against the mouth and nose of the user and is very uncomfortable.

Further, in some situations, the tightly fitting masks are often removed or pulled down to allow the user to better breath and/or communicate with other people. This is especially the case in emergency situations where various emergency service workers need to communicate with each other.

Accordingly, there is need for a solution to at least one of the aforementioned problems. For instance, there is an established need for support for a fabric face covering that prevents the fabric from coming into contact with the mouth and chin of the user.

SUMMARY OF THE INVENTION

The present invention is directed to a face mask for supporting a fabric or cloth covering to prevent the spread and contraction of diseases. The face mask includes a main curved support and a pair of ear pieces extending from opposed ends of the main curved support. A main mobile curved support is pivotally connected to the main curved support and is releasably attached to the pair of ear pieces such that the face mask may be changed from a fully expanded condition for use to a fully collapsed condition for transport. One or more intermediary curved supports are provided and are pivotally connected to the main curved support to provided additional support to the fabric or cloth covering.

In a first implementation of the invention, there is provided a cage-like face mask for use with a cloth covering to prevent the spread of diseases, the cage-like face mask comprising:

- a main curved support having a first end, a second end and a curved portion intermediate said first and second ends;
- a first ear piece movably mounted to said first end of said main curved support;
- a second ear piece movably mounted to said second end of said main curved support;
- a main mobile curved support having a first end, a second end and a curved portion intermediate said first and second ends, said main mobile curved support being pivotally connected to said main curved support; and
- at least one mobile curved support having a first end, a second end and a curved portion intermediate said first and second ends, said first and said second ends of said at least one mobile curved support being pivotally mounted to said main curved support, wherein said first end of said main mobile curved support is releasably connected to said first ear piece and said second end of said main mobile curved support is releasably connected to said second ear piece.

In a second aspect, the face mask further includes a snap block affixed to the first end of the main mobile curved support, the snap block being releasably attachable to the first ear piece.

In another aspect, the main curved support includes a central hinge in the curved portion of the main curved support to pivot a first half of the face mask against a second half of the face mask.

In another aspect, the main mobile curved support includes a central hinge in the curved portion of the main mobile curved support.

In another aspect, the at least one mobile curved support includes a central hinge in the curved portion of the at least one mobile curved support.

In another aspect, the main mobile curved support and the at least one mobile curved support are pivotally connected to the main curved support with a common pin.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a collapsible, cage-like face mask which can be used together with a cloth covering to prevent the spread of diseases.

Figure 1:
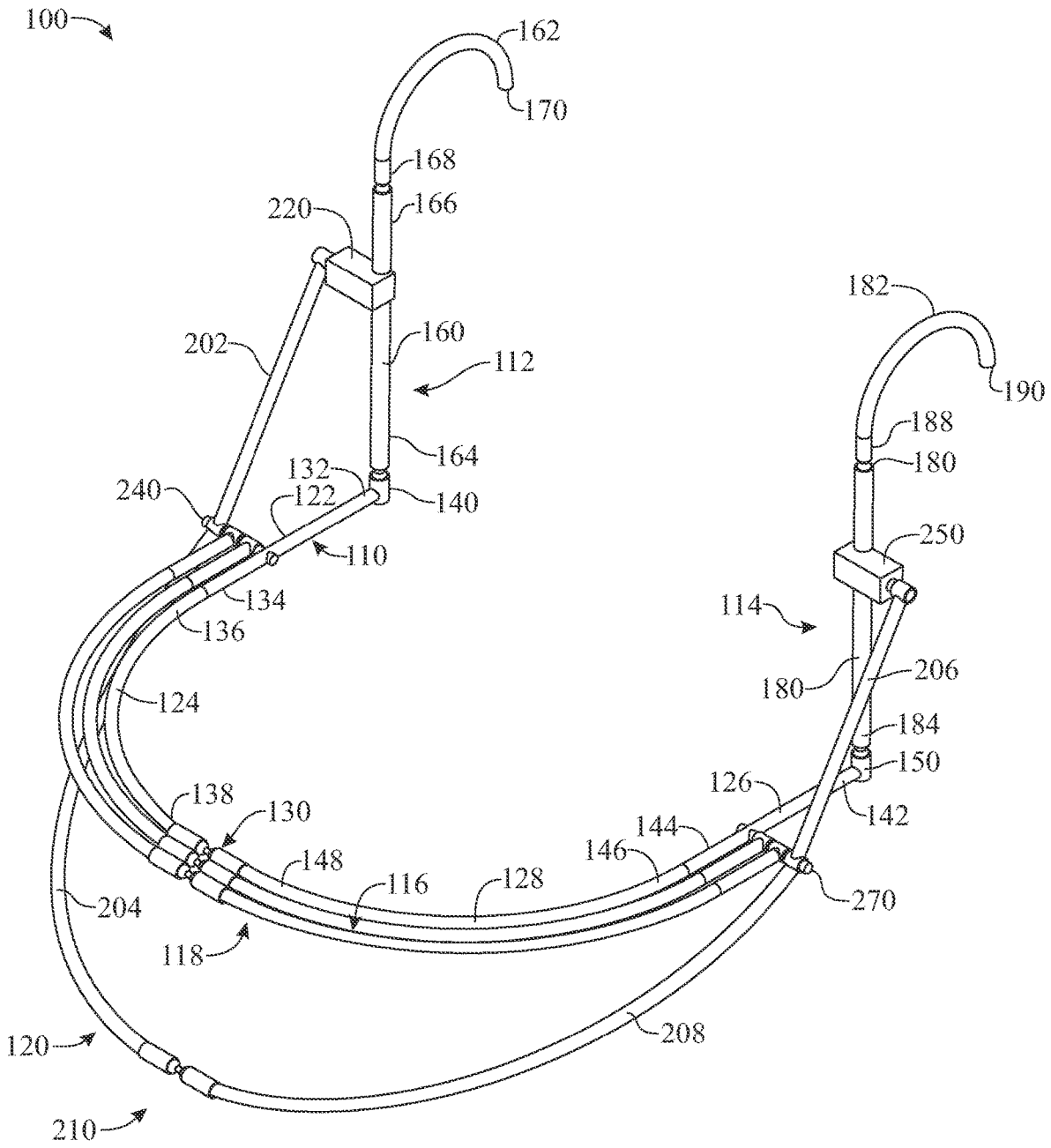
FIG. 1 presents a top, front isometric view of a cage-like face mask, in a partially open condition, in accordance with a first illustrative embodiment of the present invention.
Figure 2:
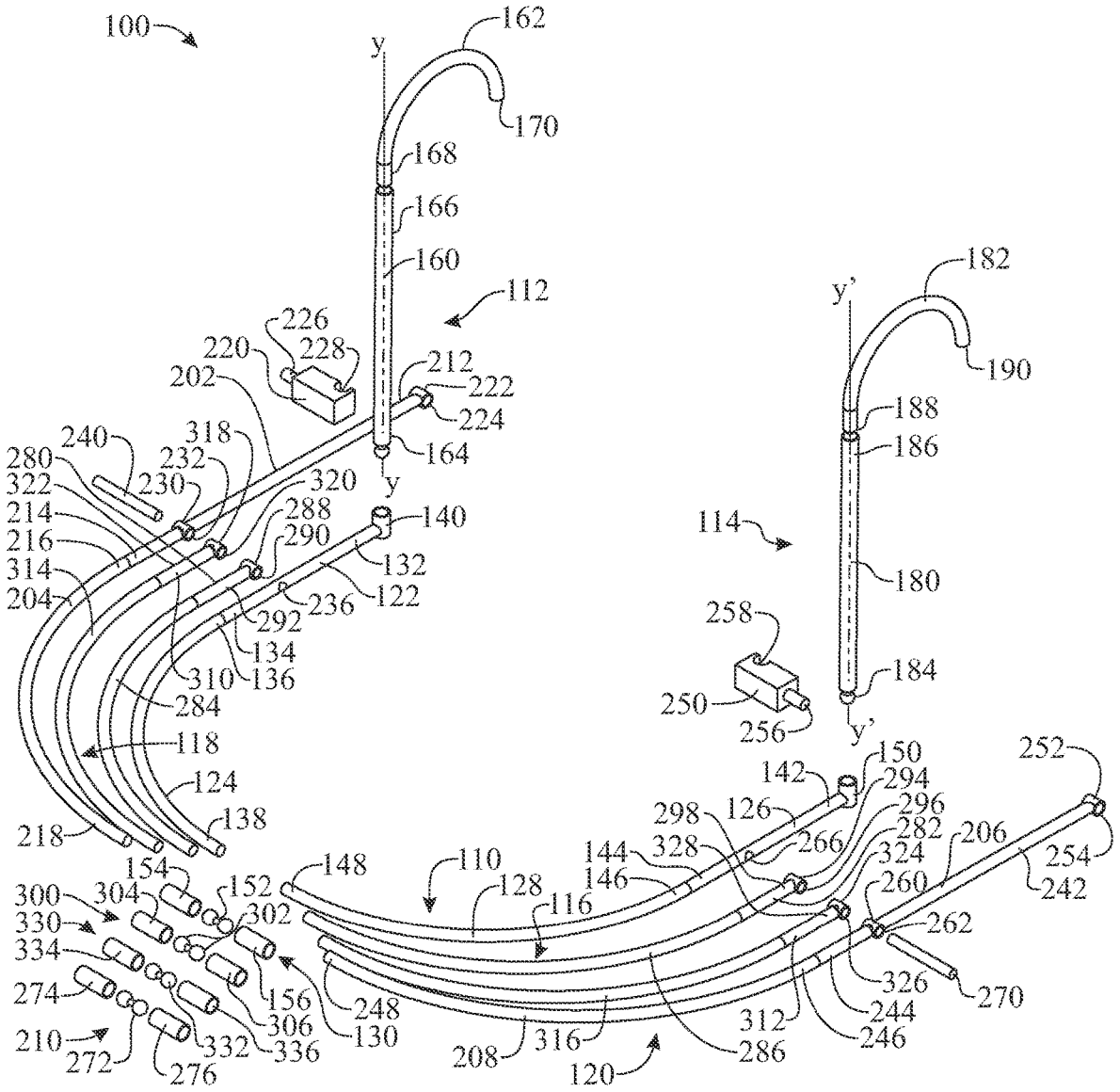
FIG. 2 presents a top, front isometric view, with parts separated, of the cage-like face mask illustrated in FIG. 1.

Referring to FIGS. 1-8, and initially with regard to FIGS. 1 and 2, a collapsible, cage-like face mask, for use in preventing the spread of diseases, hereinafter face mask 100, is illustrated in accordance with an exemplary embodiment of the present invention. The face mask 100 generally includes a main curved support 110 and a pair of ear pieces, for example a first or right side ear piece 112 and a second or left side ear piece 114, movably attached to the main curved support 110 to position the disclosed face mask 100 on a face of a user as described in more detail hereinbelow.

The face mask 100 additionally includes a pair of intermediary supports including a first mobile curved support 116 and a second mobile curved support 118 pivotally connected to the main curved support 110. A main mobile curved support 120 is pivotally mounted to the main curved support 110 and is provided to maintain the shape of the face mask 100 when the face mask 100 is in a fully open condition and is releasably connected to the right and left side ear pieces 112 and 114, respectively, to allow the face mask 100 to be collapsed to a fully collapsed condition.

The main curved support 110 is the primary support for the various described components of the face mask 100 and is foldable over onto itself to allow the face mask 100 to be moved from the fully open condition to the fully collapsed condition. The main curved support 110 generally includes a right side longitudinal portion 122 and a right side curved portion 124 extending from the right side longitudinal portion 122. The main curved support 110 similarly includes a left side longitudinal portion 126 and a left side curved portion 128 extending from the left side longitudinal portion. The right and left side curved portions 124 and 128, respectively, are pivotally connected together at a chain type first central hinge 130. It should be noted that the disclosed longitudinal and curved portions noted throughout may be formed separately or may be formed integrally together.

Specifically, the right side longitudinal portion 122 has a first end 132 and a second end 134 and the right side curved portion 124 has a first end 136 and a second end 138. The second end 134 of the right side longitudinal portion 122 is fixedly connected to the first end 136 the right side curved portion 124. A first connector 140 is provided on the first end 132 of the right side longitudinal portion 122 to pivotally receive the right side ear piece 112. The second end 138 of the right side curved portion 124 is connected to the first central hinge 130 as described in more detail hereinbelow.

Likewise, the left side longitudinal portion 126 includes a first end 142 and a second end 144 and the left side curved portion 128 includes a first end 146 and a second end 148. The second end 144 of the left side longitudinal portion 126 is fixedly connected to the first end 146 of the left side curved portion 128. A second connector 150 is provided on the first end 142 of the left side longitudinal portion 126 to pivotally receive the left side ear piece 114. The second end 148 of the left side curved portion 128 is also connected to the first central hinge 130 as discussed below.

As best shown in FIG. 2, the first central hinge 130 generally includes a first ball chain connector 152 and right and left side securing sleeves 154 and 156, respectively. The first ball chain connector 152 is a ball and chain type pivotal connection and is connected to the second ends 138 and 148 of the right and left side curved portions 124 and 128, respectively, of the main curved support 110. The right side securing sleeve 154 secures the first ball chain connector 152 to the second end 138 of the right side curved portion 124 of the main curved support 110 and the left side securing sleeve 156 secures the first ball chain connector 152 to the second end 148 of the left side curved portion 128.

As noted above, the right and left side car pieces 112 and 114, respectively, are pivotally connected to the main curved support 110 and are provided to retain the face mask 100 on the face of the user. The right side ear piece 112 includes a right side vertical portion 160 extending upward or outward from the main curved support 110 and a right side arcuate portion 162 extending from the right side vertical portion 160. In order to adjust the right side ear piece 112 relative to a user and allow the right side ear piece 112 to fold down to the collapsed condition relative to the main curved support 110, a first end 164 of the right side vertical portion 160 is movably connected to the connector 140 of the main curved support 110 in ball and socket fashion. This not only allows the right side ear piece 112 to pivot relative to the main curved support 110, but also allows the right side ear piece 112 to rotate about an axis y-y of the right side vertical portion 160 (FIG. 2) to rotate the right side arcuate portion 162 inward when moving the right side ear piece 112 to the fully collapsed condition. A second end 166 of the right side vertical portion 160 is connected to a first end 168 of the right side arcuate portion 162 and may also be connected in a ball and socket configuration or otherwise for rotation about the axis y-y. The right side arcuate portion 162 has a free or second end 170.

Similarly, the left side ear piece 114 includes a left side vertical portion 180 extending upward or outward from the main curved support 110 and a left side arcuate portion 182 extending from the left side vertical portion 180. A first end 184 is connected in ball and socked fashion to the connector 150 of the main curved support 110 and a second end 186 of the left side vertical portion 180 is rotatably connected to a first end 188 of the left side arcuate portion 182. The second end 186 of the left side vertical portion 180 is connected to a first end 188 of the left side arcuate portion 182 and may also be connected in a ball and socket configuration or otherwise for rotation about an axis y'-y' extending through the left side vertical portion 180 of the left side ear piece 114 (FIG. 2). The left side arcuate portion 182 also has a free or second end 190. The left side ear piece 114 can rotate relative to the main curved support 110 about the axis y'-y'.

As noted above, the main mobile curved support 120 is provided to maintain the face mask 100 in a fully open or expanded condition and allow the face mask 100 to be moved to a fully collapsed condition. The main mobile curved support 120 is movably mounted relative to the main curved support 110 and is detachably connected to the right and left ear pieces 112 and 114, respectively. Similar to the main curved support 110, the main mobile curved support 120 generally includes a right side longitudinal portion 202, a right side curved portion 204, a left side longitudinal portion 206 and a left side curved portion 208. The right side curved portion 204 and the left side curved portion 208 are moveably connected together by a second central hinge 210.

The right side longitudinal portion 202 of the main mobile curved support 120 has a first end 212 releasably connected to the right side ear piece 112 and a second end 214 connected to a first end 216 of the right side curved portion 204. A second end 218 of the right side curved portion 204 is connected to the second central hinge 210. In order to releasably connect the right side longitudinal portion 202 of the main mobile curved support 120 to the right side ear piece 112, the face mask 100 includes a first snap block 220 mounted on the first end 212 of the right side longitudinal portion 202 of the main mobile curved support 120.

Specifically, a barrel connector 222 defining a bore 224 is mounted on the first end 212 of the right side longitudinal portion 202 and is configured to receive a pin 226 extending from the first snap block 220. In order to releasably attach the first snap block 220, and thus the main mobile curved support 120, to the right side ear piece 112, the first snap block 220 defines a vertically extending semi-circular snap channel 228. The snap channel 228 is sized to releasably snap over or fit over the right side vertical portion 160 of the right side ear piece 112 in friction fit fashion. This allows the right side longitudinal portion 202 of the main mobile curved support 120 to be releasably attached to the right side ear piece 112 in order to maintain the face mask 100 in the fully expanded condition when the first snap block 220 is attached to the right side ear piece 112 and allow the face mask 100 to be moved to the collapsed condition when the first snap block 220 is detached from the right side ear piece 112.

As noted hereinabove, the main mobile curved support 120 is pivotally mounted to the main curved support 110. The right side longitudinal portion 202 of the main mobile curved support 120 is provided with an intermediate barrel connector 230 defining a bore 232. The right side longitudinal portion 122 of the main curved support 110 is provided with a corresponding bore 236. A first or right side pivot pin 240 extends through the bore 232 in the intermediate barrel connector 230 and through the bore 236 in the right side longitudinal portion 122 of the main curved support 110 to pivotally connect the main mobile curved support 120 to the main curved support 110.

Similarly, the left side longitudinal portion 206 has a first end 242 releasably connected to the left side ear piece 114 and a second end 244 connected to a first end 246 of the left side curved portion 208. As second end 248 of the left side curved portion is connected to the second central hinge 210. The first end 242 of the left side longitudinal portion 206 is connected to the left side ear piece 114 by a second snap block 250. A barrel connector 252 defining a bore 254 is mounted on the first end 242 of the left side longitudinal portion 206 and is provided to receive a pin 256 extending from the second snap block 250. Similar to the first snap block 220 described hereinabove, the second snap block 250 defines a semi-circular snap channel 258 that releasably connects to the left side vertical portion 180 of the left side ear piece 114.

The left side longitudinal portion 206 further includes an intermediate barrel connector 260 defining a bore 262. A corresponding bore 266 is provided through the left side longitudinal portion 126 of the main curved support 110 and a left side pivot pin 270 extends through the bores 262 and 266 to pivotally connect the main mobile curved support 120 to the main curved support 110. Similar to that described hereinabove, the second central hinge 210 includes a second ball and chain type connector 272 and right and left side securing sleeves 274 and 276. The right side securing sleeve 274 secures the second central hinge 210 to the second end 218 of the right side curved portion 204 and the left side securing sleeve 276 secures the second central hinge 210 to the second end 248 of the left side curved portion 208 of the main mobile curved support 120.

As noted hereinabove, the face mask 100 includes one or more intermediary mobile curved supports such as, for example, the first and second mobile curved supports 116 and 118, respectively. The first and second mobile curved supports 116 and 118 are constructed in similar fashion to the main curved support 110 and the main mobile curved support 120 and are pivotally connected to the main curved support 110 as described herein. For example, the first mobile curved support 116 includes right and left side longitudinal portions 280 and 282 and right and left side curved portions 284 and 286, respectively. A barrel connector 288 defining a bore 290 is provided on a first end 292 of the right side longitudinal portion 280 and a barrel connector 294 defining a bore 296 is provided on a first end 298 of the left side longitudinal portion 282. The right side pivot pin 240 extends through the bore 290 in the barrel connector 288 to and the left side pivot pin 270 extends through the bore 296 in the barrel connector 294 to pivotally connect the first mobile curved support 116 to the main curved support 110. A third central hinge 300 including a third ball and chain connector 302 and right and left side securing sleeves 304 and 306, respectively, pivotally connect the right and left side curved portions 284 and 286 of the first mobile curved support 116 together in a manner similar to that described hereinabove.

Likewise, the second mobile curved support 118 includes right and left side longitudinal portions 310 and 312 and right and left side curved portions 314 and 316, respectively. A barrel connector 318 defining a bore 320 is attached to a first end 322 of the right side longitudinal portion 310 and a barrel connector 324 defining a bore 326 is attached to a first end 328 of the left side longitudinal portion 312 to pivotally connect the second mobile curved support 118 to the main curved support 110 through the right and left side pivot pins 240 and 270, respectively. It should be noted that, the right and left side pivot pins 240 and 270 form a common pivot point for the main mobile curved support 120 and the first and second mobile curved supports 116 and 118, respectively, relative to the main curved support 110.

Finally, a fourth central hinge 330 having a ball and chain connector 332 and right and left side securing sleeves 334 and 336, respectively, pivotally connect the right and left side curved portions 314 and 316 of the second mobile curved support 118.

Figure 3:
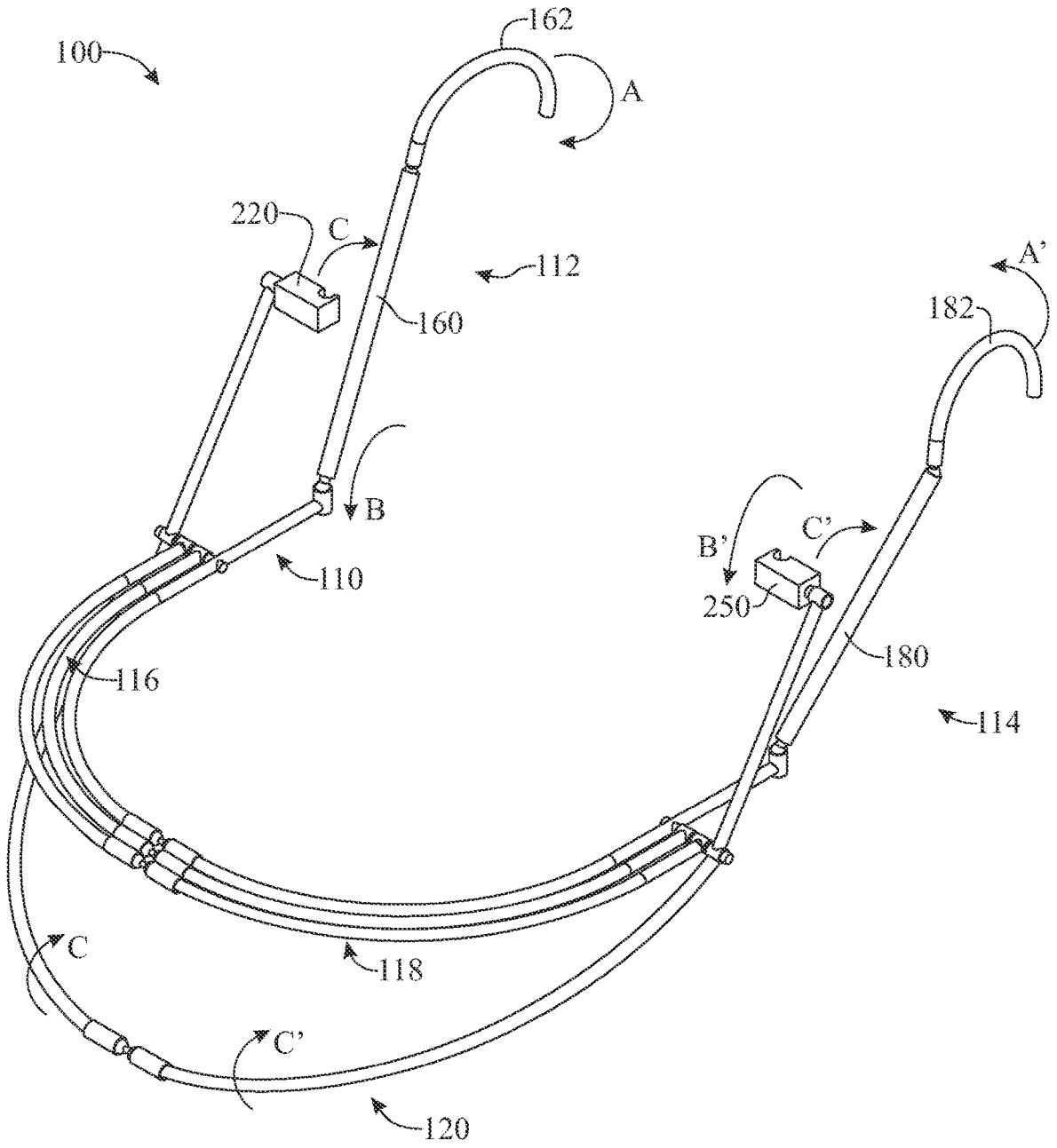
FIG. 3 presents a top, front isometric view of the cage-like face mask illustrated in FIG. 1, in a partially assembled condition.

Turning now to FIGS. 1 and 3-5, the operation of the face mask 100 to change the face mask 100 from the partially open or expanded condition (FIG. 1) to the collapsed condition for ease of transport (FIG. 5) will now be described. Initially, as shown in FIG. 1, the main mobile curved support 120 is attached to the right and left side ear pieces 112 and 114, respectively, by the first and second snap blocks 220 and 250. In order to collapse the face mask 100, the first and second snap blocks 220 and 250 are detached from their friction fit connection with the right and left side ear pieces 112 and 114 (FIG. 3). Thereafter, the right side arcuate portion 162 of the right side ear piece 112 and the left side arcuate portion 182 of the left side car piece 114 are rotated inward in the direction of arrows "A" and "A".

Figure 4:
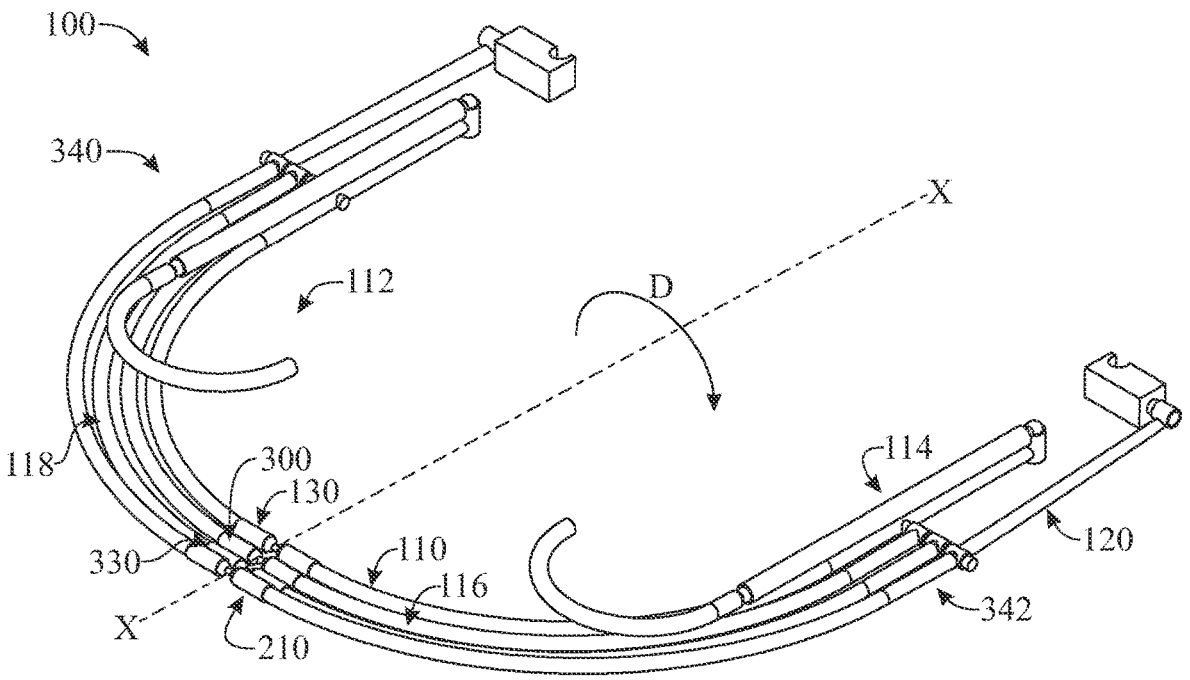
FIG. 4 presents a top, front isometric view of the cage-like face mask of FIG. 1 in a partially collapsed condition.

The right and left side vertical portions 160 and 180 of the right and left side ear pieces 112 and 114, respectively, are then pivoted downward in the direction of arrows "B" and "B" to cause the right and left side ear pieces 112 and 114 to lie flat relative to the main curved support 110 (FIG. 4). As also shown in FIG. 4, the main mobile curved support 120 is pivoted in the direction of arrows "C" and "C" to cause the main mobile curved support 120 to lie flat relative to the main curved support 110. It should be noted that the first and second mobile curved supports 116 and 118 are also pivoted in line with the main curved support 110.

Figure 5:
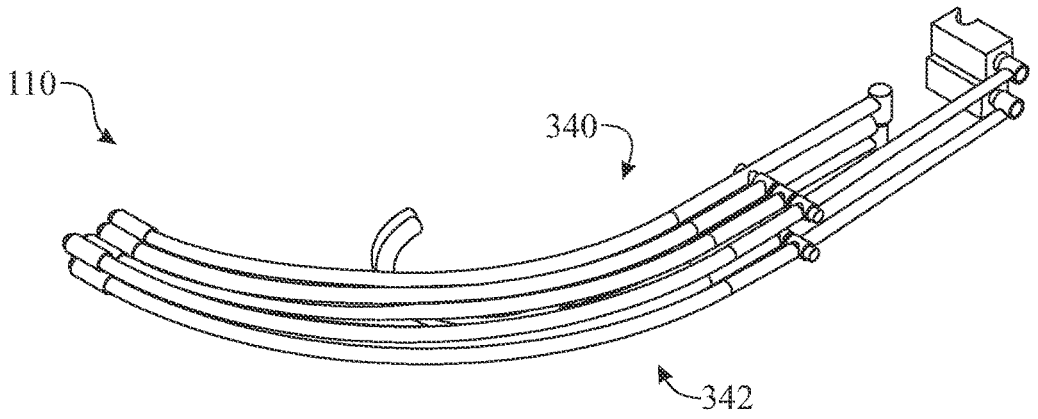
FIG. 5 presents a top, front isometric view of the cage-like face mask of FIG. 4 in a fully collapsed condition.

Once the right and left side ear pieces 112 and 114, respectively, and the main mobile curved support 120 have been pivoted down such that they are relatively in the same plane as the main curved support 110, a right half 340 of the face mask 110 can be pivoted over on a left half 342 of the face mask 100 by pivoting the right and left halves 340 and 342, respectively, in the direction of arrow "D" about the first, second, third and fourth central hinges 130, 210, 300 and 330, respectively, around an axis x-x (FIG. 4) to fold the face mask 100 into a fully collapsed condition for transport FIG. 5. In this manner, the face mask 100 can be carried in a fully collapsed condition (FIG. 5).

Figure 6:
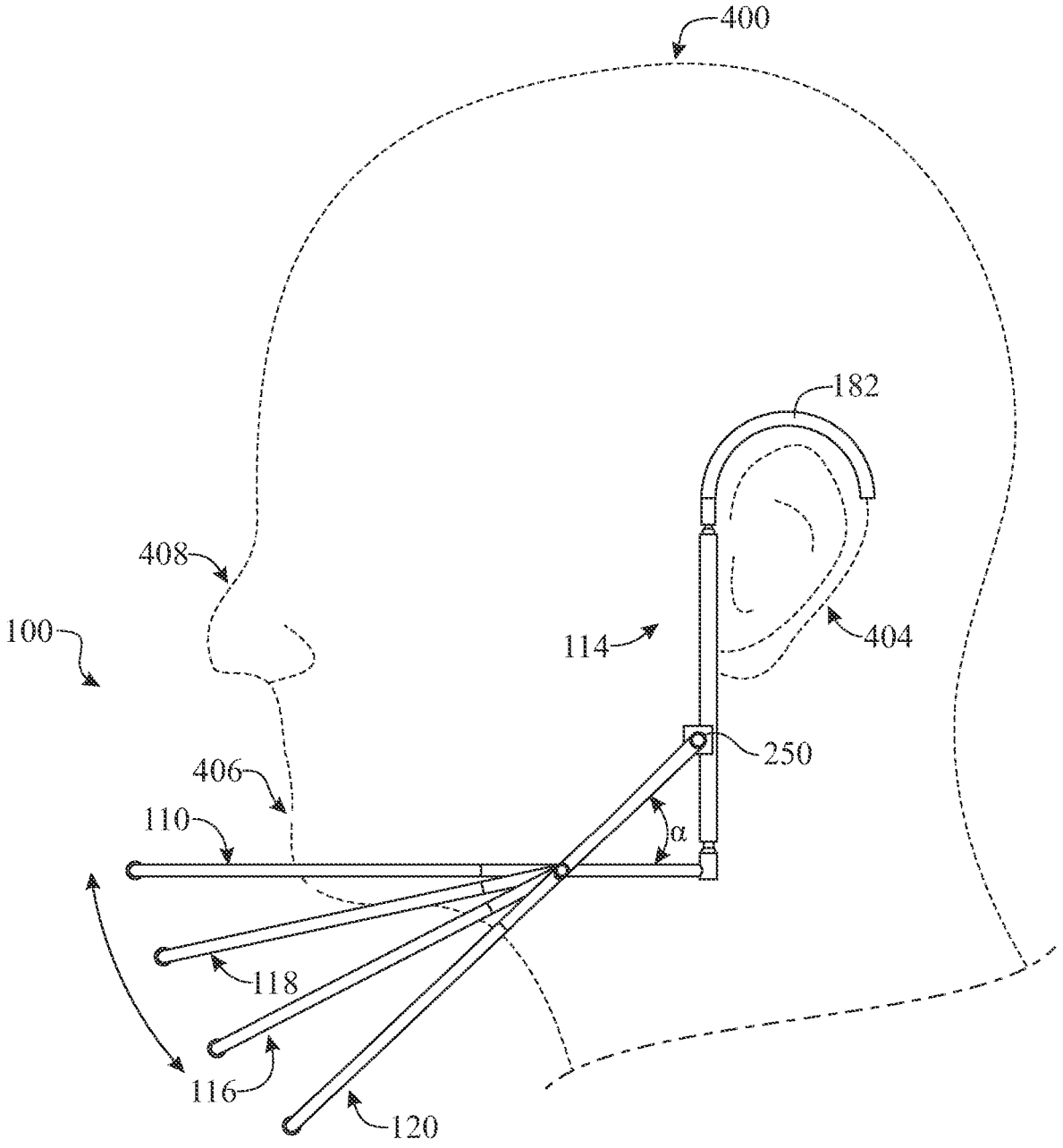
FIG. 6 presents a side plan view of the cage-like face mask of FIG. 1, positioned on a head of a user, in a fully open condition.
Figure 7:
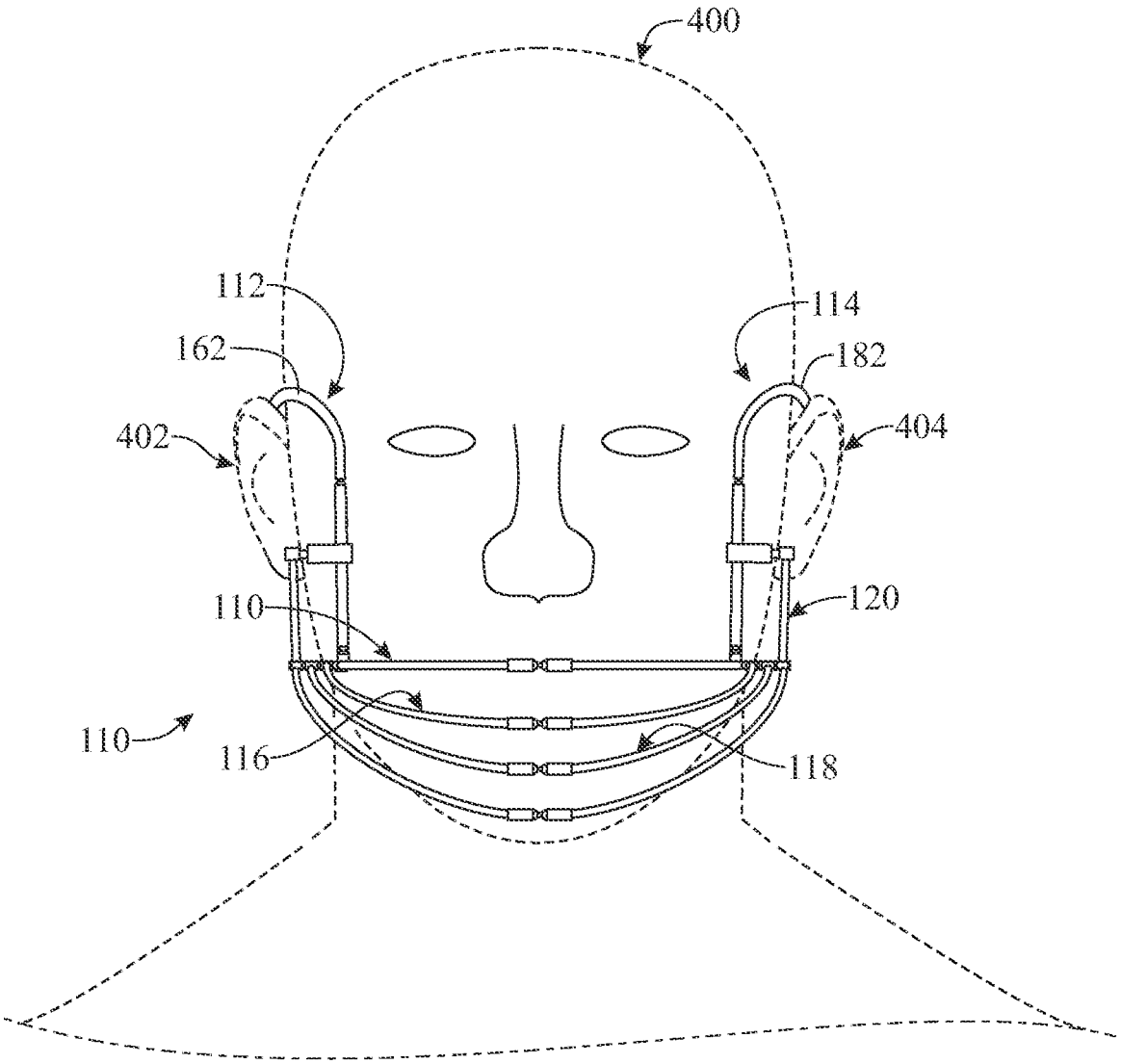
FIG. 7 presents a front, plan view of the cage-like face mask of similar to FIG. 6, in the fully open condition.

In order to use the face mask 100, the steps are reversed and the first and second snap blocks 220 and 250 are reconnected to the right and left side ear pieces 112 and 114 to maintain the face mask 100 in the fully open or expanded condition (See FIGS. 6 and 7).

The components of the face mask 100 including the main curved support 110, the right and left side ear pieces 112 and 114, the first and second mobile curved supports 116 and 118 and the main mobile curved support 120 may be formed from a variety of relatively rigid materials including metallic materials such as, for example, stainless steel or a polymeric material. Polymeric materials may include a variety of plastic such as, for instance, polylactic acid (PLA) and polyethylene terephthalate glycol (PETG). Additionally, the components of the face mask 100 may be formed from a variety of organic materials such as, for example, soft or hardwoods, reeds, bamboo, etc. It should be noted that, however, the right side arcuate portion 160 of the right side ear piece 112 and the left side arcuate portion 182 of the left side ear piece 114 may be formed from a more flexible and/or malleable material to allow the right and left side ear pieces 112 and 114, respectively, to conform to the ears of the user.

Turning now to FIGS. 6 and 7, in use, the face mask 100 is positioned on a user by first fully expanding the face mask 100 and securing it in the expanded condition with the first and second snap blocks 220 and 250, respectively. Thereafter, the face mask 100 may be positioned a head of a user such as, for example, head 400 by securing the right and left side arcuate portions 162 and 182 of the right and left side car pieces 112 and 114 about right and left ears 402 and 404 of the head. As shown, in proper position, the main curved support 110 extends forward at essentially a right angle to the right and left side ear pieces 112 and 114 and the main mobile curved support 120 is secured at a downward angle $\alpha$ relative to the man curved support 110. The first and second mobile curved supports 116 and 118 are positioned between the main curved support 110 and the main mobile curved support 120 in fan like fashion.

Figure 8:
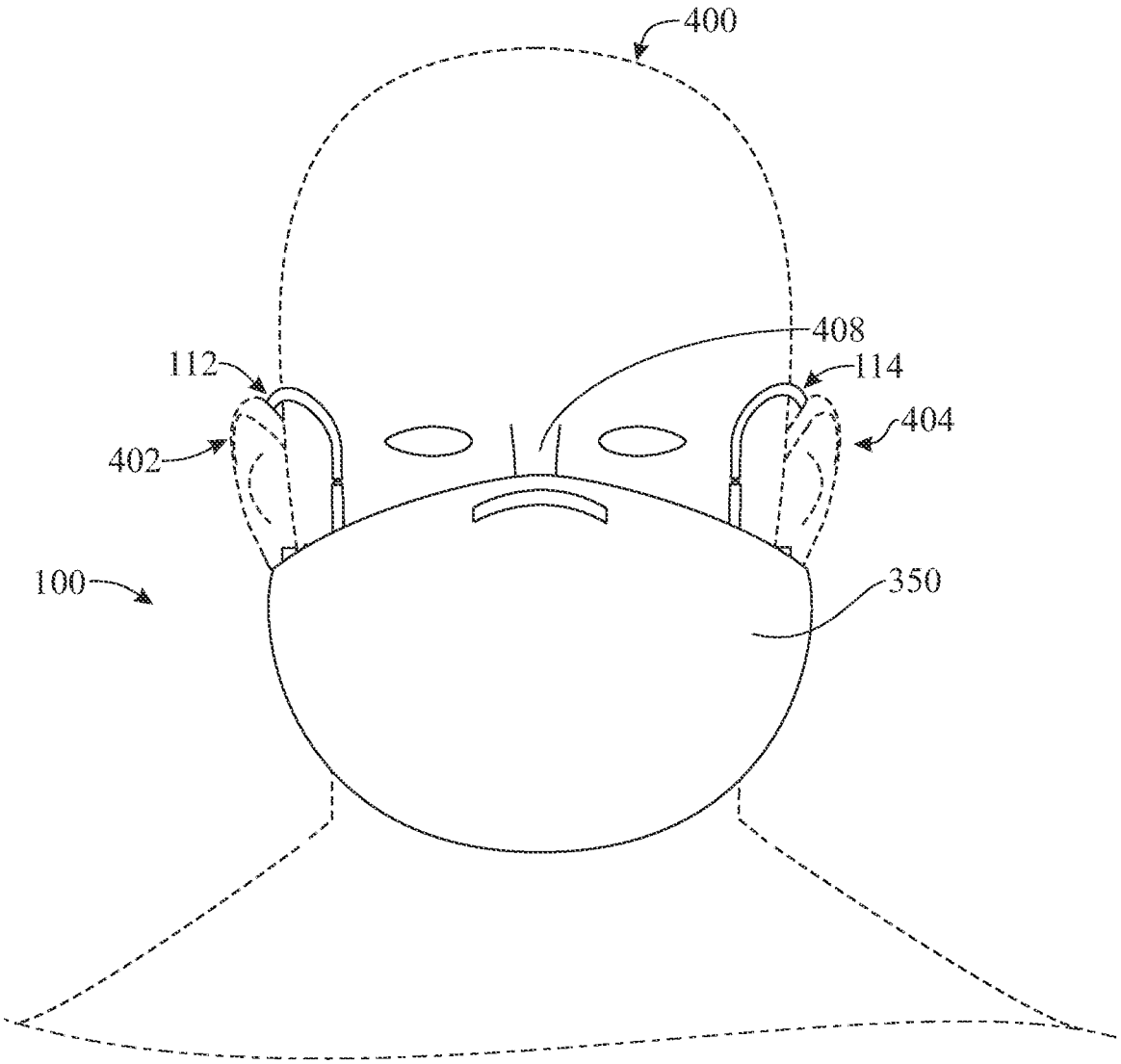
FIG. 8 presents a front, plan view of the cage-like face mask of similar to FIG. 7, including a cloth covering positioned on the cage-like face mask of FIG. 1.

Finally, with regard to FIG. 8, the face mask 100 is provided to support a fabric or cloth covering such as, for example, covering 350 in front of mouth 406 and nose 408 of the head 400 to prevent the spread of diseases. The covering 350 is secured to the main curved support 110 and the main mobile curved support 120 (FIGS. 6 and 7) in know manner such as, for example, by tying, folding, gluing, fastening, forming sleeves in the covering for receipt of the main curved support 110 and/or the main mobile curved support 120, etc. In a preferred embodiment, the covering 350 is easily removable and replaceable for sanitary purposes and to accommodate any excessive wear or damage to the covering 350. The fabric covering 350 is held away from the users mouth 406 (FIG. 7) by the face mask 100 while still allowing the fabric covering 350 to form a seal around the users nose 408 to prevent the inhalation of airborne disease and particles.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A cage-like face mask for use with a cloth covering to prevent the spread of diseases, the cage-like face mask comprising:

a main curved support having a first end, a second end and a curved portion intermediate the first and second ends;

a first ear piece movably mounted to the first end of the main curved support;

a second ear piece movably mounted to the second end of the main curved support;

a main mobile curved support having a first end, a second end and a curved portion intermediate the first and second ends of the main mobile curved support, the main mobile curved support being pivotally connected to the main curved support;

at least one mobile curved support having a first end, a second end and a curved portion intermediate the first and second ends of the at least one mobile curved support, the first and said second ends of the at least one mobile curved support being pivotally mounted to the main curved support, wherein the first end of said main mobile curved support is releasably connected to the first ear piece and the second end of the main mobile curved support is releasably connected to the second ear piece;

the main curved support including a right side longitudinal portion and a right side curved portion extending from the right side longitudinal portion and a left side longitudinal portion and a left side curved portion extending from the left side longitudinal portion, wherein the right and left side curved portions are pivotally connected together at a chain type first central hinge.

2. The cage-like face mask of claim 1, wherein the right side longitudinal portion has a first end and a second end and the right side curved portion has a first end and a second end, and further wherein the second end of the right side longitudinal portion is fixedly connected to the first end of the right side curved portion.

3. The cage-like face mask of claim 2, wherein a first connector is provided on the first end of the right side longitudinal portion to pivotally receive the first ear piece, and further wherein the second end of the right side curved portion is connected to a first central hinge.

4. The cage-like face mask of claim 1, wherein the left side longitudinal portion includes a first end and a second end and the left side curved portion includes a first end and a second end.

5. The cage-like face mask of claim 4, wherein the second end of the left side longitudinal portion is fixedly connected to the first end of the left side curved portion.

6. The cage-like face mask of claim 5, wherein a second connector is provided on the first end of the left side longitudinal portion to pivotally receive the second ear piece, and further wherein the second end of the left side curved portion is connected to a first central hinge.

7. The cage-like face mask of claim 1, wherein the at least one mobile curved support includes a pair of intermediary supports including a first mobile curved support and a second mobile curved support pivotally connected to the main curved support.

8. The cage-like face mask of claim 7, wherein the first mobile curved support includes right and left side longitudinal portions and right and left side curved portions.

9. The cage-like face mask of claim 8, wherein a barrel connector defining a bore is provided on a first end of the right side longitudinal portion and a second barrel connector defining a second bore is provided on a first end of the left side longitudinal portion.

10. The cage-like face mask of claim 9, wherein a right side pivot pin extends through the bore in the barrel connector and a left side pivot pin extends through the second bore in the second barrel connector to pivotally connect the first mobile curved support to the main curved support.

11. The cage-like face mask of claim 7, wherein the second mobile curved support includes right and left side longitudinal portions and right and left side curved portions.

12. The cage-like face mask of claim 11, wherein a barrel connector defining a bore is attached to a first end of the right side longitudinal portion and a second barrel connector defining a second bore is attached to a first end of the left side longitudinal portion to pivotally connect the second mobile curved support to the main curved support.

13. The cage-like face mask of claim 1, wherein the face mask further includes a first snap block mounted on the first end of the main mobile curved support.

14. The cage-like face mask of claim 1, wherein the face mask is configured to support a covering, and further wherein the covering is secured to the main curved support and the main mobile curved support by at least one means of tying, folding, gluing, fastening, and forming sleeves.

15. The cage-like face mask of claim 14, wherein the covering is removable and replaceable.

16. A cage-like face mask for use with a cloth covering to prevent the spread of diseases, the cage-like face mask comprising:

a main curved support having a first end, a second end and a curved portion intermediate the first and second ends, wherein the main curved support includes a right side longitudinal portion and a right side curved portion extending from the right side longitudinal portion, and the main curved support additionally includes a left side longitudinal portion and a left side curved portion extending from the left side longitudinal portion, wherein the right and left side curved portions and are pivotally connected together at a chain type first central hinge;

a first ear piece movably mounted to the first end of the main curved support;

a second ear piece movably mounted to the second end of the main curved support;

a main mobile curved support having a first end, a second end and a curved portion intermediate the first and second ends of the main mobile curved support, the main mobile curved support being pivotally connected to the main curved support; and at least one mobile curved support having a first end, a second end and a curved portion intermediate the first and second ends of the at least one mobile curved support, the first and said second ends of the at least one mobile curved support being pivotally mounted to the main curved support, wherein the first end of said main mobile curved support is releasably connected to the first ear piece and the second end of the main mobile curved support is releasably connected to the second ear piece.

17. A cage-like face mask for use with a cloth covering to prevent the spread of diseases, the cage-like face mask comprising:

a main curved support having a first end, a second end and a curved portion intermediate the first and second ends, wherein the main curved support includes a right side longitudinal portion and a right side curved portion extending from the right side longitudinal portion, and the main curved support additionally includes a left side longitudinal portion and a left side curved portion extending from the left side longitudinal portion, wherein the right and left side curved portions and are pivotally connected together at a chain type first central hinge;

a first ear piece movably mounted to the first end of the main curved support;

a second ear piece movably mounted to the second end of the main curved support;

a main mobile curved support having a first end, a second end and a curved portion intermediate the first and second ends of the main mobile curved support, the main mobile curved support being pivotally connected to the main curved support through a snap block; and at least one mobile curved support having a first end, a second end and a curved portion intermediate the first and second ends of the at least one mobile curved support, the first and said second ends of the at least one mobile curved support being pivotally mounted to the main curved support, wherein the first end of said main mobile curved support is releasably connected to the first ear piece and the second end of the main mobile curved support is releasably connected to the second ear piece.

* * * * *